United States Patent [19]

Reich

[11] 4,057,044

[45] Nov. 8, 1977

[54] HYDRAULIC ANEROID CONTROL AND FLUID FLOW RESTRICTING DEVICE FOR USE THEREWITH

[75] Inventor: Steven Anthony Reich, Waterloo, Iowa

[73] Assignee: Deere & Company, Moline, Ill.

[21] Appl. No.: 650,182

[22] Filed: Jan. 19, 1976

[51] Int. Cl.[2] ..... F02D 1/04

[52] U.S. Cl. ..... 123/140 MP; 123/140 FG; 137/513.3

[58] Field of Search ..... 123/140 MP, 140 FG, 123/140 R, 140 MC; 137/513.3

[56] References Cited

U.S. PATENT DOCUMENTS

| | | | |
|---|---|---|---|
| 1,036,479 | 8/1912 | Flamm | 137/513.3 |
| 1,294,380 | 2/1919 | Benson | 137/513.3 |
| 2,318,962 | 5/1943 | Parker | 137/513.3 |
| 2,853,159 | 9/1958 | Kuhn, Jr. | 137/513.3 X |
| 3,669,143 | 6/1972 | Reese | 137/513.3 X |
| 3,707,144 | 12/1972 | Galis et al. | 123/140 MP X |
| 3,818,883 | 6/1974 | Glassey | 123/140 MP X |

*Primary Examiner*—Charles J. Myhre

*Assistant Examiner*—Tony M. Argenbright

[57] ABSTRACT

Disclosed herein is a hydraulic aneroid control consisting of a housing containing a hydraulic piston and a flow control mechanism. The housing attaches to the governor housing so that the piston can move the fuel control shaft which engages the aneroid. When the engine is started, engine oil pressure acts on the piston to engage the aneroid. When the engine is not running, spring force moves the piston and fuel control shaft to the disengage position. The flow control mechanism restricts oil flow into the cylinder thus slowing the piston movement and increasing the time to engagement so that even though engine oil comes up to pressure almost immediately upon cranking of the engine, aneroid engagement is delayed until after the engine starts. The flow control mechanism also includes a check valve to bypass the flow restriction when the engine is shut down so that the aneroid is disengaged quickly and the engine has a fast re-start capability. In the preferred embodiment of the invention the flow restriction takes the form of a bore with a wire loosely positioned therein, the bore and wire forming a capillary.

7 Claims, 4 Drawing Figures

FIG. 1
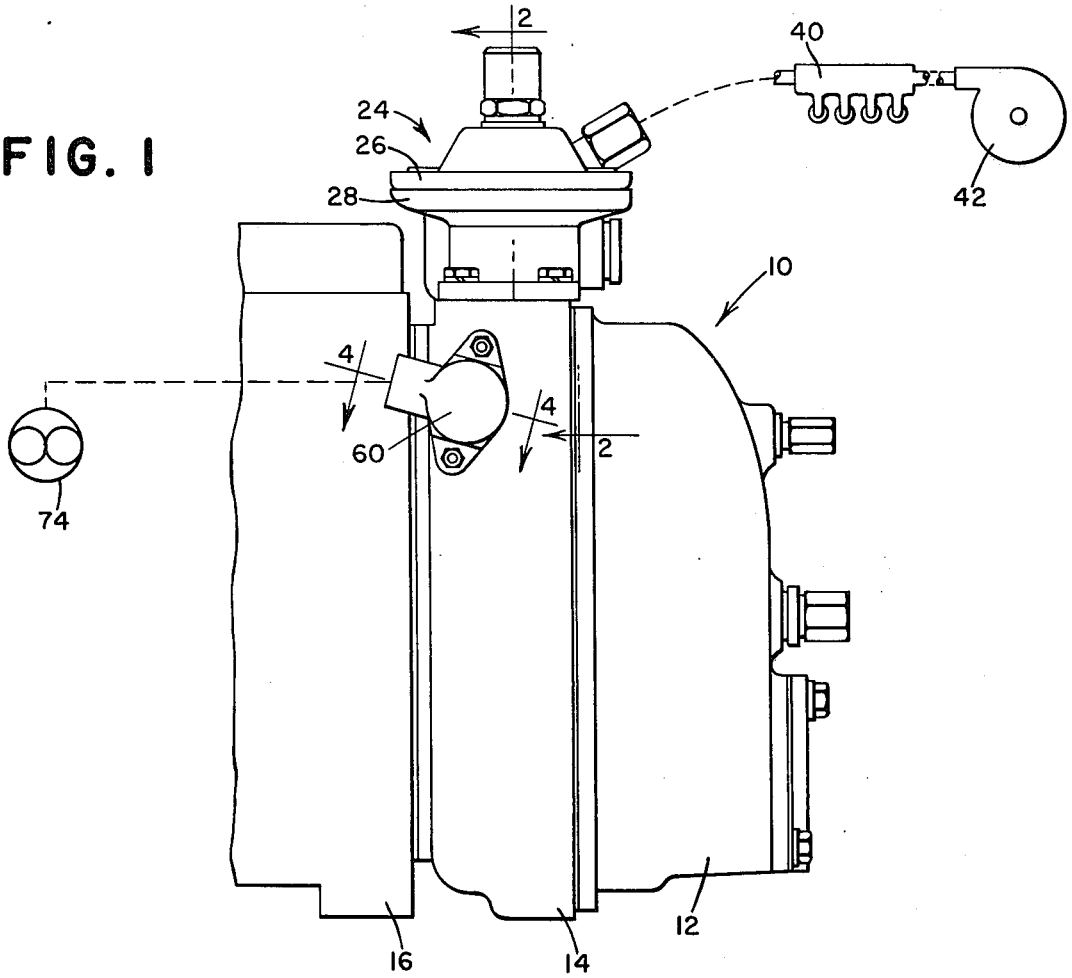
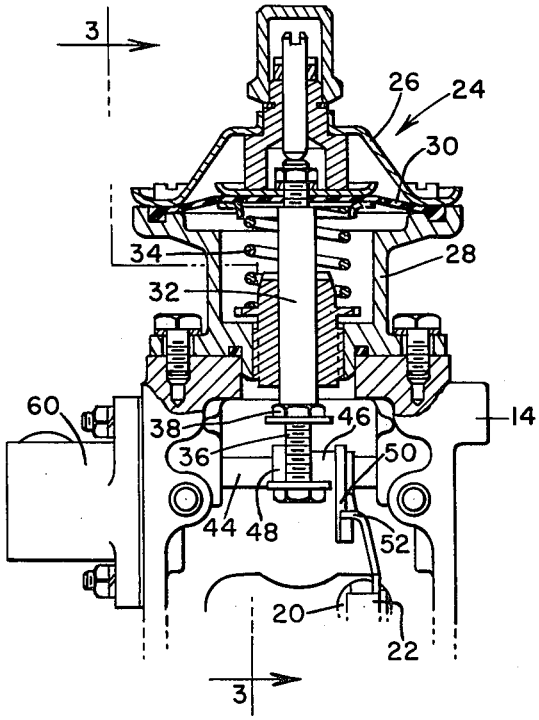
FIG. 2

HYDRAULIC ANEROID CONTROL AND FLUID FLOW RESTRICTING DEVICE FOR USE THEREWITH

BACKGROUND OF THE INVENTION

The present invention relates generally to governor control fuel injection pumps for use with turbocharged diesel engines and more specifically relates to a hydraulic aneroid control and flow control device therefor to be used with a fuel injection pump assembly.

Under certain speed and load conditions adequate air is not available in a turbocharged engine to correspond with the amount of fuel injected into each cylinder of the engine. Such an overfueling condition creates unnecessary black smoke. For example, in an engine provided with an exhaust driven supercharger the manual governor control can be advanced faster than the engine and supercharger can build up enough speed to provide sufficient air to the combustion spaces of the engine to support complete burning of the fuel being injected therein during a given cycle. Also, as the load on an engine increases until engine speed is decreased from that indicated by the governor setting, the engine governor attempts to regain the engine speed by automatically advancing the engine fuel rack to supply more fuel and reduction in supercharger speed as a result of the reduced engine speed results in insufficient air being supplied to the engine to support complete burning of the additional fuel being injected.

To overcome over-fueling situations and get rid of the unnecessary and objectionable black smoke it has become common to equip the injection pump assemblies with a diaphragm type control unit known as an aneroid which is responsive to intake manifold pressure to limit the movement of the control rack of the injection pump assembly during periods of low manifold pressure. However, many times, particularly in cold weather, over-fueling is required for starting the engine. Therefore, the aneroid is generally provided with a starting fuel control shaft which can be manipulated to deactivate the aneroid so that over-fueling will be permitted for starting.

There have been many suggestions for devices to automatically control the manipulation of the aneroid fuel control shaft. One suggestion for mechanical control is illustrated in U.S. Pat. No. 3,786,794 but this and other mechanical systems are lacking in reliability. A previous hydraulic aneroid control device known to applicant consists of a cylinder and piston mounted on the side of a fuel pump governor housing and connected to the engine oil pump. Upon receipt of oil pressure from the engine oil pump the piston moves the fuel control shaft to the aneroid and engages the aneroid. Since the engine oil comes up to pressure almost immediately upon cranking the aneroid fuel control shaft is shifted almost immediately. The aneroid and fuel control shaft operate such that when the shaft is in the engaged position the aneroid will engage after the fuel rack is pulled back by the governor flyweights. This happens as the engine starts to accelerate from cranking speed. Thus, the engine will have full rack for the first surge of speed, but only for that surge. If the engine should die, the rack cannot go back into the starting fuel position until oil pressure falls off and allows the fuel control shaft to disengage.

SUMMARY OF THE INVENTION

The object of the present invention is to provide an improved hydraulic aneroid control and flow control device therefor which delays aneroid engagement for a period of time after the oil pressure of the engine with which it is used comes up to pressure.

The above object and additional objects and advantages of the present invention will become apparent to those skilled in the art from a reading of the following detailed description when taken in conjunction with the accompanying drawings.

BRIEF DESCRIPTION OF THE DRAWINGS

In the drawings:

FIG. 1 is a side elevational view of a portion of a governor controlled fuel injection pump assembly;

FIG. 2 is a sectional view taken substantially along the lines 2—2 of FIG. 1;

DESCRIPTION OF THE PREFERRED EMBODIMENT

Figure 3:
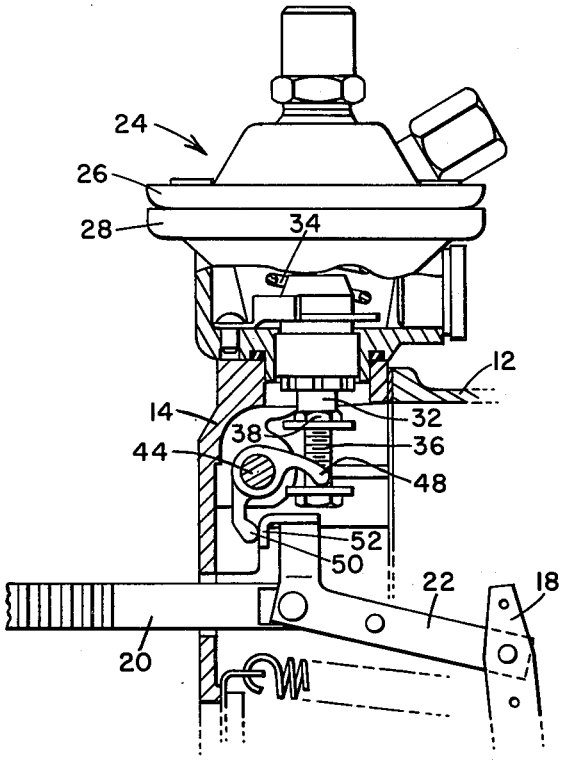
FIG. 3 is a sectional view taken substantially along the lines 3—3 of FIG. 2.

Referring now to the drawings, the fuel injection pump assembly partially illustrated therein is indicated generally at 10 and includes housing sections 12, 14 and 16. The housing sections 12 and 14 house a typical governor and governor linkage, and the housing section 16 carries the pump plungers and plunger controls. The governor linkage includes a control rack lever 18 which is connected to a fuel control rack 20 by a link 22. The fuel control rack 20 extends into the housing section 16 where it acts on the pumping elements of the pump to control the rate of fuel delivery. Movement of the control rack 20 to the left as viewed in FIG. 3 increases pump delivery and movement of the control rack 20 to the right decreases pump delivery.

The governor and governor linkage is of conventional structure and therefore will not be further described except for the following brief description of its operation. When the engine with which the pump assembly is used is stopped, the control rack lever 18 will have moved the control rack 20 to an extreme left position, a starting fuel position which is further to the left than that illustrated in FIG. 3. As the engine is started the governor acts on the control rack lever 18 to move the control rack 20 to the right until centrifugal forces and spring forces acting on the governor mechanism are balanced. The engine speed at which the forces are balanced is determined by the position of a manually adjustable speed control lever. Ignoring for the time being the effect of the aneroid to be described hereinafter, any movement of the speed control lever requiring additional engine speed results in the governor linkage moving the fuel control rack back to its extreme left position until centrifugal forces begin to overcome the spring forces and move the control rack 20 back to the right as the engine reaches its indicated speed. If the engine begins to lug and the speed drops off the governor linkage again moves the fuel control rack 20 to its extreme left position until the engine again approaches the speed indicated by the speed control lever setting and the rack 20 is moved back to the right.

The aneroid indicated generally at 24 is also of conventional construction and includes a housing made up of housing sections 26 and 28, a flexible diaphragm 30 clamped between the two housing sections, a vertical adjusting shaft 32 having its upper end connected to the diaphragm and its lower end extending into the governor housing section 14 and a spring 34 normally biasing the flexible diaphragm and hence the vertical adjusting shaft upwardly. The lower end of the vertical adjusting shaft is provided with an axially threaded bore which receives a threaded screw 36 whose head end includes an integral flange. A nut 38 having an integral flange is also threaded on the screw 36 against the lower end of a vertical adjusting shaft to lock the screw 36 in position.

The diaphragm 30 divides the aneroid into upper and lower chambers and the upper chamber is adapted to be connected to the intake manifold of the engine with which it will be used. For purposes of explanation, a typical intake manifold is schematically illustrated at 40 and an exhaust driven turbocharger for supplying air to the manifold 40 is schematically illustrated at 42. The spring 34 in diagram 30 normally holds the vertically adjusting shaft 32 in its upward position illustrated in FIGS. 2 and 3, and the diaphragm 30 is responsive to pressure within the upper chamber of the aneroid to overcome the bias of the spring 34 and move the vertical adjusting shaft 32 downwardly. The pressure within the upper chamber of the aneroid is sensed from the intake manifold 40 and is dependent upon the amount of air delivered by the turbocharger 42.

The aneroid 24 limits the movement of the fuel control rack 20 to the left by way of a starting fuel control shaft 44 which is slidably and rotatably mounted within the governor housing 14. A fuel control lever is mounted on the shaft 44 and includes a sleeve portion 46 which is fixed with respect to the shaft 44, a first arm 48 extending from the sleeve and riding on the upper surface of the integral washer on the screw 36, and a second arm 50 which extends downwardly and engages an abutment portion 52 on the link 22. A spring 54 is mounted on a projecting end of the starting fuel control shaft 44 and acts between a mounting bushing 56 for the starting fuel control shaft 44 and a snap ring 58 on the starting fuel control shaft 44 to normally urge the starting fuel control shaft 44 to the left as viewed in FIG. 2. When the starting fuel control shaft 44 is in the position illustrated in FIG. 2, the arms 48 and 50 of the fuel control lever act between the screw 36 and abutment 52 of the link 22 to limit movement of the fuel control rack 20 to the left, and when the starting fuel control shaft 44 is moved to the left by the action of the spring 54 the arm 50 moves off the abutment 52 so that the aneroid 24 has no effect on the movement of the fuel control rack 20. Movement of the starting fuel control shaft 44 to the left as viewed in FIG. 2 is limited so that the arm 48 does not move off the end of the adjusting screw 36.

Figure 4:
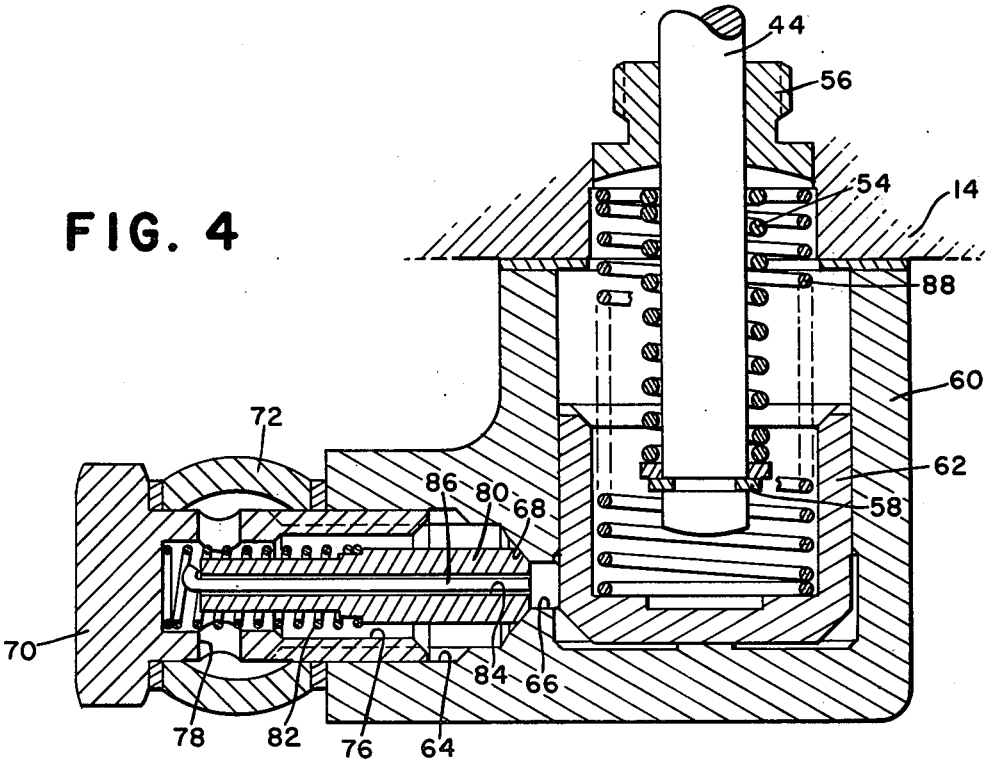
FIG. 4 is a sectional view taken substantially along the lines 4—4 of FIG. 1.

The hydraulic aneroid control and flow control device therefor which form the subject matter of the present invention are best illustrated in FIG. 4 and include a main housing portion 60 which is secured to the side of the governor housing 14. The housing 60 forms a hydraulic cylinder and the projecting end of the starting fuel control shaft 44 projects into the cylinder. A piston 62 is slidably mounted in the cylinder and is adapted to contact and move the starting fuel control shaft 44 upwardly as viewed in FIG. 4 or to the right as viewed in FIG. 2 against the bias of the spring 54. As can be seen in FIG. 4, the piston 62 is also hollow and the starting fuel control shaft 44 projects part way into the piston 62. However, when the piston 62 is in its completely retracted position as illustrated in FIG. 4 it has a predetermined amount of travel before contacting the starting fuel control shaft 44.

The housing 60 is provided with an oil port 64 which communicates with the cylinder formed by the housing 60 by way of an opening 66 which is of reduced size with respect to the port 64. The walls of the port 64 taper to the opening 66 to form a valve seat 68. A hollow plug 70 is threaded into the port 64 and clamps a connector banjo 72 between the head of the plug 70 and the housing 60. The banjo 72 is adapted to be connected to an oil pump of the engine with which the fuel injection pump assembly will be used. For purposes of illustration, a typical oil pump 74 is schematiclly illustrated in FIG. 1

The bore 76 of the hollow plug 70 is in fluid communication with the interior of the connector banjo by way of radial passages 78. A cylindrical valving member 80 is positioned within the hollow plug 70 and is provided with a tapered end portion which abuts against the valve seat 68. The porion of the cylindrical valving member 80 which is remote from the valve seat 68 is of reduced diameter and a spring 82 is positioned therearound and acts between the end of the bore 76 and a shoulder formed on a cylindrical valving member to normally hold the valving member against the valve seat 68. Since the spring 82 encircles a portion of the cylindrical valving member 80 it also serves as a guide for the valving member 80. A bore 84 extends through the valving member 80 to provide communication between the bore of the hollow plug 70 and the opening 66, and a wire 86 is loosely positioned within the bore 84. The bore 84 and wire 86 form an easily manufactured capillary which restricts the flow of fluid from the pump 74 to the cylinder formed by the housing 60. By using the wire 86 and the bore 84, the bore size can be approximately doubled, thus making a reasonable hole size for manufacturing. By using the floating or loosely positioned wire within the bore, the opening or orifice is self scrubbing and presents a hole geometry that is difficult to clog.

The use of a spring loaded valving member 80 provides a quick discharge for the cylinder formed by the housing 60. In this regard, a spring 88 acts between the bushing 56 and piston 62 to urge the piston outwardly so that, in the absence of fluid pressure from the pump 74, the fluid pressure within the piston as a result of the spring 88 will lift the valving member 80 from the seat 68 so that fluid that can be quickly discharged from the cylinder by bypassing the capillary.

Assuming the fuel injection assembly described is mounted on a turbocharged engine, its operation is substantially as follows. Prior to the engine starting, the pistons 62 will have assumed the position illustrated in FIG. 4, the starting fuel control shaft 44 will have moved to the left as viewed in FIG. 2 so that it does not restrict the movement of the fuel control rack, and the fuel control rack 20 will have moved to its starting fuel position. As soon as cranking of the engine starts, oil from the pump 74 comes up to pressure almost immediately, but movement of the starting fuel control shaft 44 to the right as viewed in FIG. 2 is delayed since the capillary formed by the bore 84 and wire 86 restricts the flow of fluid to the cylinder and the piston must travel a predetermined distance prior to engaging the starting fuel control shaft 44. As the engine starts to fire and accelerate from cranking speed, the fuel control rack 20 moves to the right and the abutment 52 is moved back to where the starting fuel control shaft 44 can again move to the right and engage the arm 50 on the abutment 52. Since there is a delay before the starting fuel control shaft 44 moves to the right, the starting fuel control rack 20 is free to return to its starting fuel position in the event the engine dies after the first surge of speed. Should the engine die after it has run long enough for the starting fuel control shaft 44 to be returned to its engaged position, the spring 88 acting on the piston 62 will dump the fluid from the cylinder by way of the check valve formed by the valving member 80 and valve seat 68 as soon as engine oil pressure falls off. This allows the starting fuel control shaft 44 to quickly move to it unengaged position and facilitate restarting of the engine.

When the starting fuel control shaft 44 is moved to its right, engaged position the movement of the fuel control rack 20 in an increased fuel direction is limited by the aneroid. Specifically, if the speed control lever is moved to a position indicating increased speed, but the supercharger 42 is running too slow to supply the required amount of combustion air to the manifold 40, the vertical adjusting shaft 32 will be in its upper position and the arms 48 and 50 will act between the screw 36 and abutment 52 to limit the movement of the fuel control rack. If the tractor begins to lug and the governor calls for increased fuel the same events just described will occur.

From the foregoing description and illustration it can be seen that the present invention provides a hydraulic aneroid control which delays engagement of the aneroid for a predetermined time after engine oil comes up to pressure, which can quickly release the aneroid in the envent the engine dies, and which includes a novel capillary flow control device.

Having thus described a preferred embodiment of the invention, various modifications within the spirit and scope of the invention will become apparent to those skilled in the art and can be made without departing from the underlying principles of the invention. Therefore, the invention should not be limited to the specific illustration and description of the single preferred embodiment, but only by the following claims.

I claim:

1. In a fuel injection pump assembly for use with a turbocharged internal combustion engine, the injection pump assembly including a governor controlled fuel control rack, an aneroid adapted to be connected to and responsive to pressure within the intake manifold of the engine with which it will be used to limit movement of the fuel control rack in a direction to increase fuel delivery during periods of low intake manifold pressure, the aneroid having a control member shiftable between rack engaged and disengaged positions, means resiliently urging the shiftable control member to the rack disengaged position, and hydraulic cylinder and piston means adapted to be connected to and responsive to fluid pressure from the oil pump of the engine with which it will be used to move the shiftable control member to the rack engaged position, the improvement comprising: the piston of the hydraulic cylinder and piston means having a predetermined amount of travel prior to contacting and moving the shiftable member, and the hydraulic cylinder and piston means includes a flow restricting means limiting the flow of fluid thereto whereby, when in use with an engine the aneroid will be unable to limit fuel control rack movement until a period of time after the oil pump of the engine has operated at pressure.

2. The pump assembly as set forth in claim 1 wherein the flow restricting means is a capillary.

3. The pump assembly as set forth in claim 2 wherein the capillary is formed with a large bore and a wire of smaller diameter than the bore is loosely positioned within the bore.

4. The pump assembly as set forth in claim 1 wherein the hydraulic cylinder and piston means includes one way check valve means in parallel with the flow restricting means to permit substantially unrestricted flow of fluid from the hydraulic cylinder and piston means.

5. The pump assembly as set forth in claim 4 wherein the flow restricting means and the one way valve means includes a housing forming a chamber having a first opening communicating with the hydraulic piston and cylinder means and a second opening adapted to be in communication with the outlet of the oil pump of the engine with which it will be used, a valve member positioned within the chamber and normally yieldably biased to a position in which it covers the first opening, and a restricted passage extending through the valve member in constant fluid communication with the first opening.

6. The pump assembly as set forth in claim 5 wherein the restricted passage includes a bore through the valve member and a wire of smaller diameter than the bore loosely positioned therein, the bore and wire forming a capillary.

7. The pump assembly as set forth in claim 6 wherein spring means act on the piston of the hydraulic cylinder and piston means to bias the piston away from the shiftable member, the spring means exerting sufficient force on the piston to create a fluid pressure great enough to move the valve member away from the first opening whenever there is no fluid pressure in the chamber.

* * * * *